US009163430B1

(12) United States Patent
Britson

(10) Patent No.: US 9,163,430 B1
(45) **Date of Patent: *Oct. 20, 2015**

(54) DRAWER LOCK

(71) Applicant: Scott Aaron Britson, Garner, IA (US)

(72) Inventor: Scott Aaron Britson, Garner, IA (US)

(73) Assignee: Stellar Industries, Inc., Garner, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/937,759

(22) Filed: Jul. 9, 2013

Related U.S. Application Data

(63) Continuation of application No. 13/331,414, filed on Dec. 20, 2011, now Pat. No. 8,523,301.

(51) Int. Cl.
*A47B 95/00* (2006.01)
*E05B 65/46* (2006.01)
*A47B 88/04* (2006.01)

(52) U.S. Cl.
CPC ..... *E05B 65/46* (2013.01); *A47B 88/04* (2013.01)

(58) Field of Classification Search
USPC ..... 312/333, 334.1, 334.7–334.12, 312/334.16–334.18, 334.36–334.39, 312/334.44, 334.47, 334.6
See application file for complete search history.

(56) References Cited

U.S. PATENT DOCUMENTS

| | | | | |
|---|---|---|---|---|
| 69,068 | A * | 9/1867 | Brada | 312/334.27 |
| 3,450,453 | A * | 6/1969 | Tazaki | 312/222 |
| 3,497,280 | A * | 2/1970 | Karel et al. | 312/219 |
| 4,168,103 | A * | 9/1979 | Hagen | 312/219 |
| 4,525,012 | A * | 6/1985 | Dunner | 312/222 |
| 5,209,572 | A * | 5/1993 | Jordan | 384/18 |
| 6,375,235 | B1 * | 4/2002 | Mehmen | 292/128 |
| 6,386,659 | B1 * | 5/2002 | Muller et al. | 312/334.38 |
| 6,851,774 | B2 * | 2/2005 | Chen et al. | 312/334.47 |
| 6,945,620 | B2 * | 9/2005 | Lam et al. | 312/334.6 |
| 7,744,174 | B2 * | 6/2010 | Peng et al. | 312/333 |
| 2007/0057608 | A1 * | 3/2007 | Chiu | 312/334.1 |
| 2007/0257588 | A1 * | 11/2007 | Chen et al. | 312/333 |
| 2010/0314981 | A1 * | 12/2010 | Koenig et al. | 312/333 |

* cited by examiner

*Primary Examiner* — Matthew Ing
(74) *Attorney, Agent, or Firm* — David M. Breiner; G. Brian Pingel; Camille L. Urban

(57) ABSTRACT

A drawer assembly includes a drawer body that is slideably coupled within a cabinet housing using a slide assembly. The slide assembly includes an outer slide portion having a blocking tab disposed thereon. The slide assembly further includes a slide mount having an engagement tab pivotably mounted thereon. The engagement tab engages the blocking tab to lock the drawer assembly. The engagement tab can be released by turning a twist-lock mechanism, which actuates a lever that engages an actuator tab extending inwardly.

11 Claims, 8 Drawing Sheets

DRAWER LOCK

CROSS-REFERENCE TO RELATED APPLICATIONS

This application is a continuation of U.S. patent application Ser. No. 13/331,414 filed with the United States Patent and Trademark Office on Dec. 20, 2011, the entire contents of which is herein incorporated by reference.

BACKGROUND

Typically, utility drawer sets found on utility trucks or in other heavy duty applications can be locked, however the effective locks typically act on every drawer simultaneously. The locking mechanism may be of several types, but often includes a rotational locking mechanism which, when turned, moves two oppositely extending arms via a cam. These arms, in turn, affect the raising or lowering of a vertical bar on each side. Generally, the vertical bar and each drawer are equipped with interacting parts, which secure the drawers when the vertical bar is in a first position, and which unsecure them when the vertical bar is in a second position. However, these conventional mechanisms do not allow for independently locking drawers.

There are some locking mechanisms available that allow drawers to be independently locked and unlocked. Most operate via a blocking element disposed in the drawer slide. However, drawers having these conventional mechanisms typically are easy to unlock, even when they are secured by a handle-activated locking mechanism. That is because the locking mechanism, in its locked position, is usually located and arranged such that insertion of a screwdriver or like-shaped item between the drawer's front face and the cabinet structure enclosing the drawer or drawer set, at one side of the drawer, allows contact with the mechanism. Pushing in on the mechanism, or in some cases pushing the mechanism to the side, will move the blocking element enough that it no longer blocks the drawer slide and allows the drawer to be opened.

SUMMARY

This summary is provided to introduce a selection of concepts in a simplified form that are further described below in the Detailed Description. This summary is not intended to identify key features or essential features of the claimed subject matter, nor is it intended to be used, in isolation, as an aid in determining the scope of the claimed subject matter. At a high level, embodiments of the invention relate to an improved linkage between a locking mechanism activated by a handle and at least one drawer slide wherein said improvement provides a secure manner of locking a drawer against theft or accidental opening during transport. Embodiments of the invention relate to a drawer body slideably positioned in a cabinet enclosure.

According to various embodiments of the invention, the drawer is slideably engaged with the cabinet enclosure by one or two drawer slides. The slides are usually mounted on the side of the drawer (though can, in embodiments, be mounted elsewhere such as, for example, on the bottom of the drawer) and between the side of the drawer and a side surface of the cabinet enclosure. The drawer's front panel is accessible and bears a handle. In an embodiment, the handle is associated with a spring-loaded twist-lock mechanism. The twist-lock mechanism incorporates a locking mechanism comprising a lever and an actuator tab.

In embodiments, a two part lever is pivoted by turning the handle, wherein, upon activation, an outer part pivots to move its outer end upward. The upward movement causes the outer part to engage a movable tab associated with a blocking mechanism. When the moveable tab's position is changed by the movement of the outer part of the lever, the blocking mechanism is, in turn, re-positioned to block any sliding movement. Upon de-activation, the drawer is again able to slide. The movable tab's shape, mechanism, orientation and position, and the location and action of the outer part of the two-part lever, all as related to the position of the gap between the front of the drawer and the cabinet enclosure provides a tamper-proof arrangement.

A first illustrative embodiment of the present invention relates to a slide assembly that facilitates slideably mounting a drawer body within a cabinet enclosure. In embodiments, the slide assembly includes a slide mount that is fixed to a side panel of the drawer body; an outer slide portion that is fixed to a side member of the cabinet enclosure, wherein the slide mount can be slideably disposed within the outer slide portion; and an actuator member that is pivotably coupled to the slide mount. According to embodiments, the slide assembly further includes an actuator tab, coupled with the actuator member, that extends inwardly away from the actuator member; a lever that actuates the actuator tab; and an engagement tab coupled to the actuator member and extending outwardly away from the actuator member. According to various embodiments, the engagement tab is adapted to engage a blocking tab disposed on the outer slide portion.

A second illustrative embodiment of the present invention relates to a drawer assembly that includes a drawer body slideably disposed within a cabinet enclosure. In embodiments, the drawer assembly includes a drawer body having a front panel, rear panel, and two opposed side panels; and a slide assembly that is slideably coupled between a side panel and the cabinet enclosure. In embodiments, the slide assembly includes an outer slide portion having a blocking tab disposed thereon and a slide mount having an actuator member pivotably coupled thereto. The actuator member can be actuated using a lever that actuates the actuator member by engaging the actuator tab. In further embodiments, the drawer assembly includes a front guard that is disposed over the actuator tab and the lever.

A third illustrative embodiment of the present invention relates a slide assembly that facilitates slideably mounting a drawer body within a cabinet enclosure. In embodiments, the slide assembly includes an outer slide portion that is fixed to a side member of the cabinet enclosure, an intermediate slide portion that is slideably disposed within the outer slide portion, and a slide mount that is slideably disposed within the intermediate slide portion. The slide mount is fixed to a side panel of the drawer body and an actuator member is pivotably coupled to the slide mount. According to embodiments of the invention, an actuator tab extends inwardly away from an end of the actuator member and an engagement tab extends outwardly away from the actuator member. The actuator tab can be actuated by a lever is operated using a twist-lock mechanism pivotably coupled to the lever via an arm member.

These and other aspects of the invention will become apparent to one of ordinary skill in the art upon a reading of the following description, drawings, and the claims.

BRIEF DESCRIPTION OF THE DRAWINGS

The present invention is described in detail below with reference to the attached drawing figures, wherein.

DETAILED DESCRIPTION

The subject matter of embodiments of the invention disclosed herein is described with specificity to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other technologies.

Figure 1:
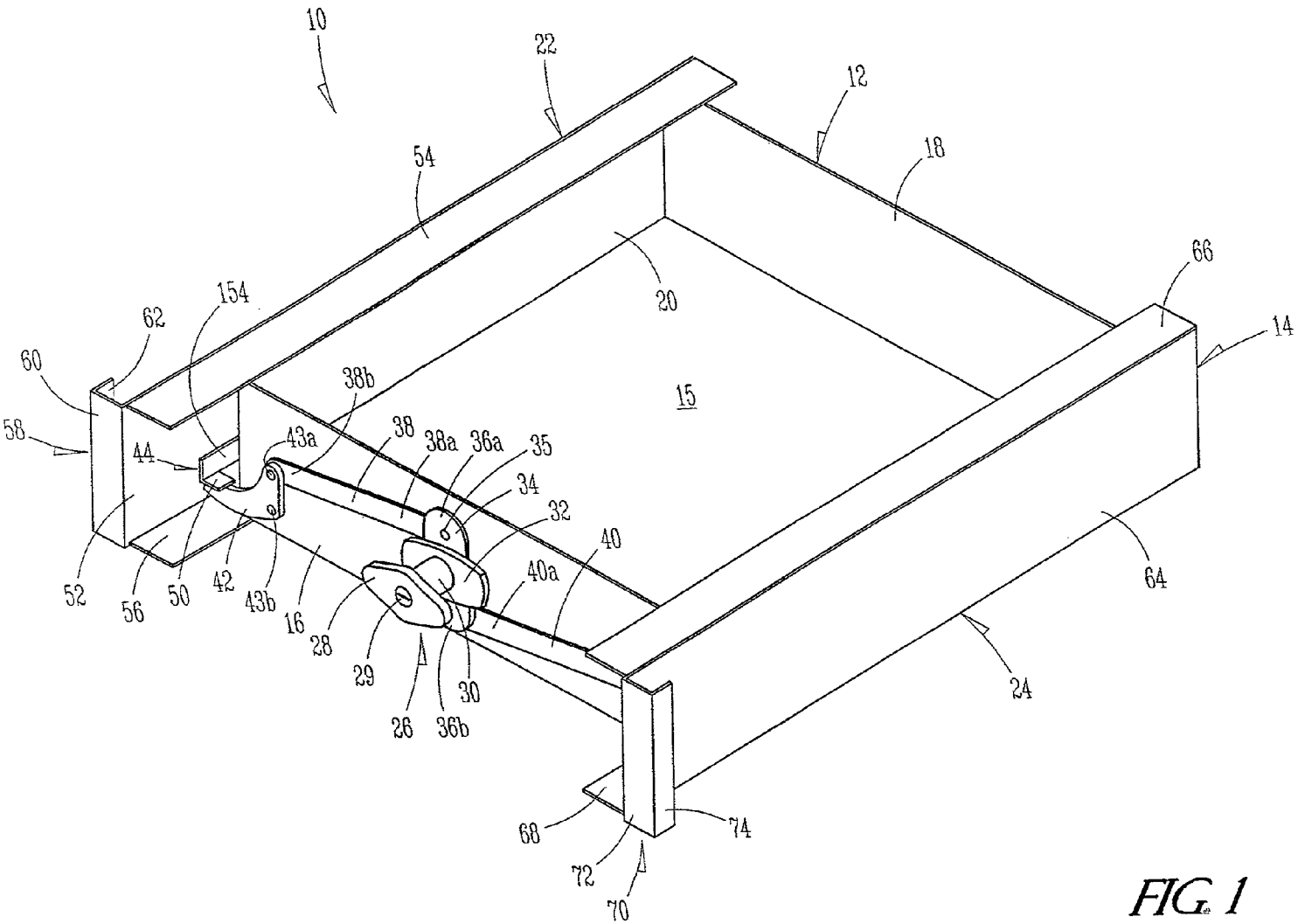
FIG. 1 is a perspective view of a drawer assembly with a front guard panel removed to show interior assembly, in accordance with embodiments of the invention.

Turning to FIG. 1, an illustrative drawer assembly 10 is depicted in a perspective view. As illustrated, the illustrative drawer assembly 10 includes a drawer body 12 disposed within a cabinet enclosure 14. The drawer body 12 includes a front guard panel 16 (not shown) for anti-theft purposes, a rear panel 18, two opposing side panels 20 and 21 (see FIGS. 2 and 3), and a drawer bottom 15. In embodiments, each side panel 20 and 21 extends between an outside edge of the front panel 16 and an outside edge of the rear panel 18 to form a generally rectangular frame that is closed at the bottom by the drawer bottom 15. The drawer body 12 is slideably disposed within the cabinet enclosure 14 as shown in FIG. 1. That is, each side panel 20 and 21 of the drawer body 12 is adapted to slide within a cabinet side assembly 22 and 24, respectively.

As is further illustrated in FIG. 1, the drawer assembly 10 has the front panel 16 (not shown) removed to show the structure of a twist-lock mechanism 26 having a handle 28 with a key-lock 29 disposed therein. The key-lock 29 is adapted to receive a key (not illustrated for the purposes of brevity and clarity of explanation), which activates the key-lock 29. When the key-lock is in a locked state, the handle 28 cannot be turned and when the key-lock is in an unlocked state, the handle 28 can be turned. In some embodiments, rather than having a key-lock 29, the drawer assembly 10 can include any number of other types of locks such as, for example, a turning combination lock, a push-button combination lock, a finger-print sensor lock, a voice-activated lock, and the like. Accordingly, it should be appreciated by individuals having skill in the relevant arts that the key-lock 29 can be situated on the drawer body 12 in a location other than in the handle 28 such as, for example, on the front panel 16, on the cabinet enclosure 14, or the like, provided that the lock, when in a locked state, prevents an operator from turning the handle 28.

With continued reference to FIG. 1, the twist-lock mechanism 26 further includes a handle shaft 30 that extends between the handle 28 and a plate 32. The plate 32 is associated with a link 34 so that the link 34 moves in correspondence to movement of the handle 28 as is well-known in the art. A first arm member 38 is pivotably connected, at a first end 38*a* thereof, to a first end 36*a* of the link 34 at a pivot 35. A second arm member 40 is pivotably connected, at a first end 40*a* thereof, to a second end 36*b* of the link 34 at a pivot (not shown). As illustrated in FIG. 1, the first arm member 38 also is pivotably connected, at a second end 38*b* thereof, to a lever 42 at a pivot 43*a*. The lever 42 also is pivotably coupled with the front panel 16 (not shown) of the drawer body 12 at pivot 43*b*. Similarly, as shown in FIG. 2, the second arm member 40 is pivotably connected, at a second end 40*b* thereof, to a lever 84 at a pivot 85*a*.

Figure 2:
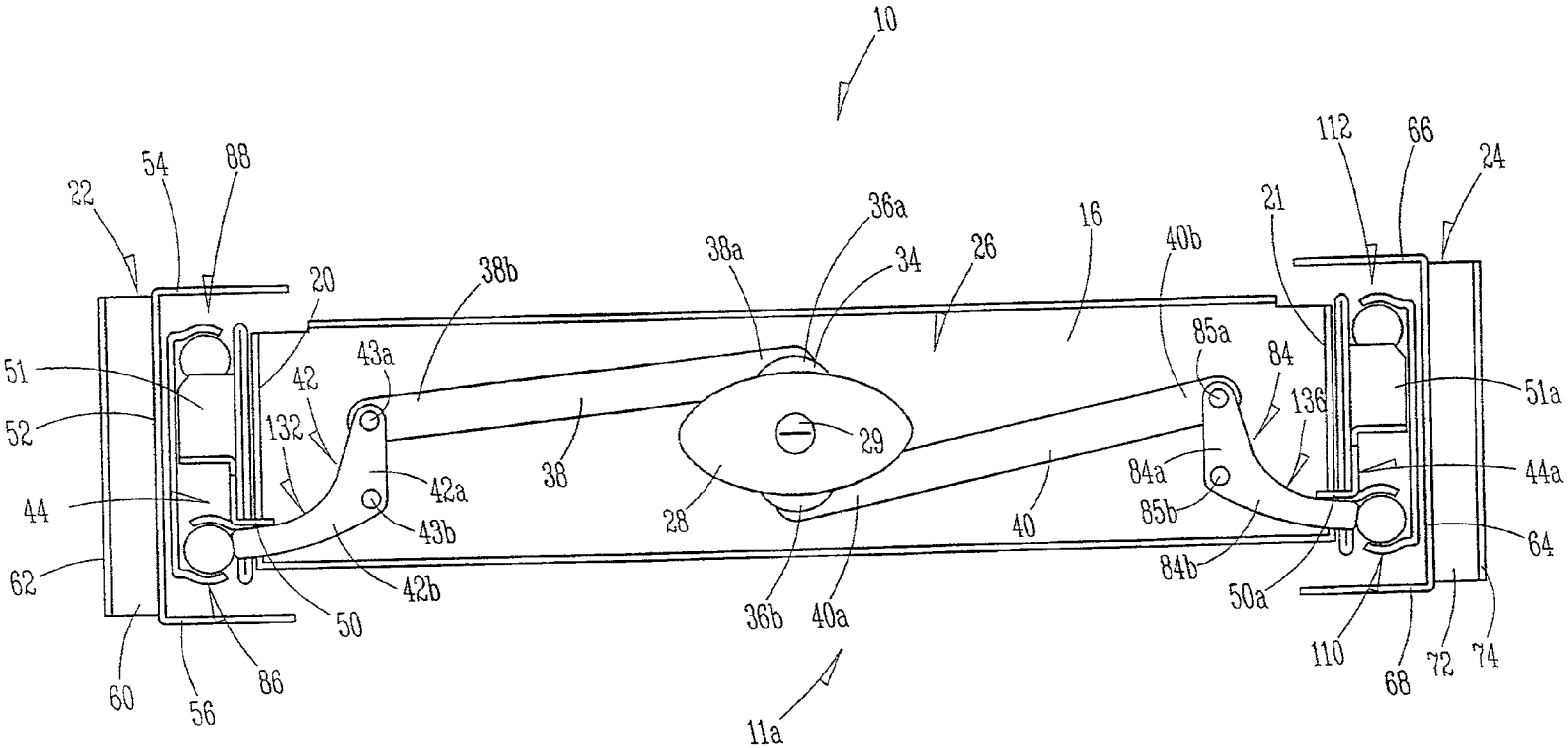
FIG. 2 is a front view of a drawer assembly with the front guard removed and the twist-lock mechanism in a first position, in accordance with embodiments of the invention.
Figure 3:
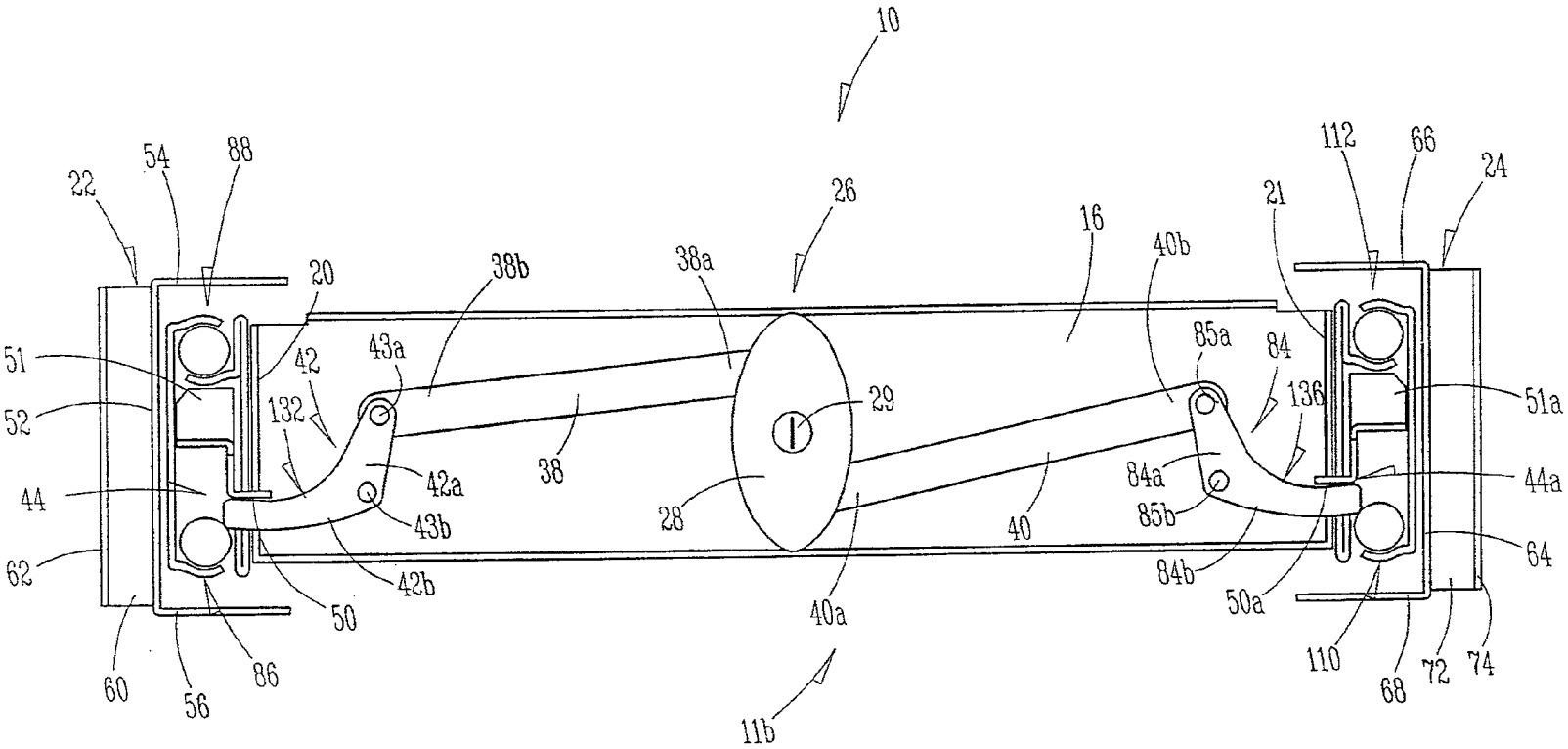
FIG. 3 is a front view of the drawer assembly of FIG. 2, with the front guard removed and the twist-lock mechanism in a second position, in accordance with embodiments of the invention.

Turning now to FIGS. 2 and 3, the operation of the twist-lock mechanism 26 and arm members 38 and 40 is depicted. In FIG. 2, the twist-lock mechanism 26 is in a first position 11*a*. In operation, an operator turns the handle 28 in a clockwise direction to achieve a second position 11*b*, shown in FIG. 3. As the handle 28 is being turned in the clockwise direction, the first arm member 38 is pulled, by operation of the link 34, in a direction toward the center of the drawer (e.g., toward the handle 28) and the second arm member 40 is pulled, by operation of the link 34, in a direction toward the center of the drawer (e.g., in the opposite direction in which the first arm member 38 is pulled). According to embodiments, the handle 28 can be turned by an operator until the twist-lock mechanism 26 is in the second position, depicted in FIG. 3.

With continued reference to FIGS. 1 and 2, the lever 42 includes a first portion 42*a* and a second portion 42*b*. The first portion 42*a* is pivotably coupled, at a pivot 43*a*, to the second end 38*b* of the first arm member 38 and extends generally in a downward direction from the pivot 43 to a pivot 43*b*. The second portion 42*b* of the lever 42 extends away from the pivot 43*b* in a direction that is at least somewhat perpendicular to the first portion 42*a*, thereby forming a generally L-shaped lever 42. The second portion 42*b* of the lever 42 actuates a first blocking mechanism 44, which will be described in more detail below with reference to FIGS. 4-7, by engaging an actuator tab 50. Similarly, as shown in FIG. 2, the second arm member 40 actuates a lever 84. As illustrated in FIG. 2, the lever 84 includes a first portion 84*a* and a second portion 84*b*. The first portion 84*a* is pivotably coupled, at a pivot 85, to the second end 40*b* of the second arm member 40 and extends generally in a downward direction from the pivot 85*a* to a pivot 85*b*. The second portion 84*b* of the lever 84 extends away from the pivot 85*b* in a direction that is at least somewhat perpendicular to the first portion 85*a*, thereby forming a generally L-shaped lever 84. The second portion 84*b* of the lever 84 actuates a second blocking mechanism 44*a* by engaging an actuator tab 50*a*.

As is shown in FIGS. 1-3, the actuator tab 50 is a component of a slide assembly 86 that is disposed within a slide cavity 88 defined within the cabinet side assembly 22. The slide assembly 86 slideably couples the first side panel 20 of the drawer body 12 to the cabinet slide assembly 22, thereby allowing the drawer body 12 to slide into and out of the cabinet enclosure 14. As shown in FIGS. 1-3, the cabinet side assembly 22 includes a side member 52, an upper flange 54, and a lower flange 56. The side member 52 is oriented generally parallel to the side panel 20 of the drawer body 12 and the upper and lower flanges 54 and 56 extend inward (e.g., toward the drawer body 12), thereby defining a slide cavity 88 in which the slide assembly 86 is disposed. The slide assembly 86, therefore, slideably couples the side panel 20 of the drawer body 12 to the side member 52 of the cabinet side assembly 22, allowing the side panel 20 of the drawer body 12 to slide within the slide cavity 88.

With particular reference to FIG. 1, the cabinet side assembly 22 also includes a first forward flange assembly 58 that includes a first portion 60 that extends outwardly in a substantially perpendicular direction from the forward edge of the side member 52. A second portion 62 of the first forward flange assembly 58 extends in a substantially perpendicular direction from the outside edge of the first portion 60, extending in the direction of the back of the cabinet enclosure 14, as shown. Similarly, a second slide assembly 112 is disposed within a second cabinet side assembly 24, which is provided on the opposite side of the cabinet enclosure 14. As illustrated in FIG. 1, the second cabinet side assembly 24 includes a side member 64 that is oriented substantially parallel to the second side panel 21 of the drawer body 12. The second cabinet side assembly 24 further includes an upper flange 66 and a lower flange 68. Each flange 66 and 68 extends inwardly from the top and bottom edges, respectively, of the side member 64, thereby defining a second slide cavity 112 therein. The second slide assembly 110 is slideably disposed within the second slide cavity 112, slideably coupling the second side panel 21 of the drawer body 12 to the side member 64 of the second cabinet side assembly 24.

With continued reference to FIGS. 2 and 3, the first lever 42 includes an upper surface 132 of the second portion 42*b* of the lever 42. The upper surface 132 of the lever 42 engages an actuating tab 50 that is coupled to a blocking tab 51. Similarly, the second lever 84 includes an upper surface 136 of the second portion 84*b* of the lever 84. When the handle 28 is turned in a clockwise direction by an operator, the movement of the link 34 causes the arm members 38 and 40 to move inward, thereby pulling inwardly on the first portions 42*a* and 84*a* of the levers 42 and 84, respectively. In turn, this inward movement of the first portions 42*a* and 84*a* of the levers 42 and 84 cause the levers 42 and 84 to pivot about the pivots 43*b* and 85*b*, thereby causing the second portions 42*b* and 84*b* of the levers 42 and 84 to move upward. The upward movement of the second portions 42*b* and 84*b* of the levers 42 and 84 pushes the actuating tabs 50 and 50*a* upward, thereby moving the blocking tabs 51 and 51*a* out of the way of engagement tabs (such as, for example, engagement tab 95, illustrated in FIGS. 4 and 5, providing the ability to slide the drawer body 12 in and out of the cabinet enclosure 14.

Figure 4:
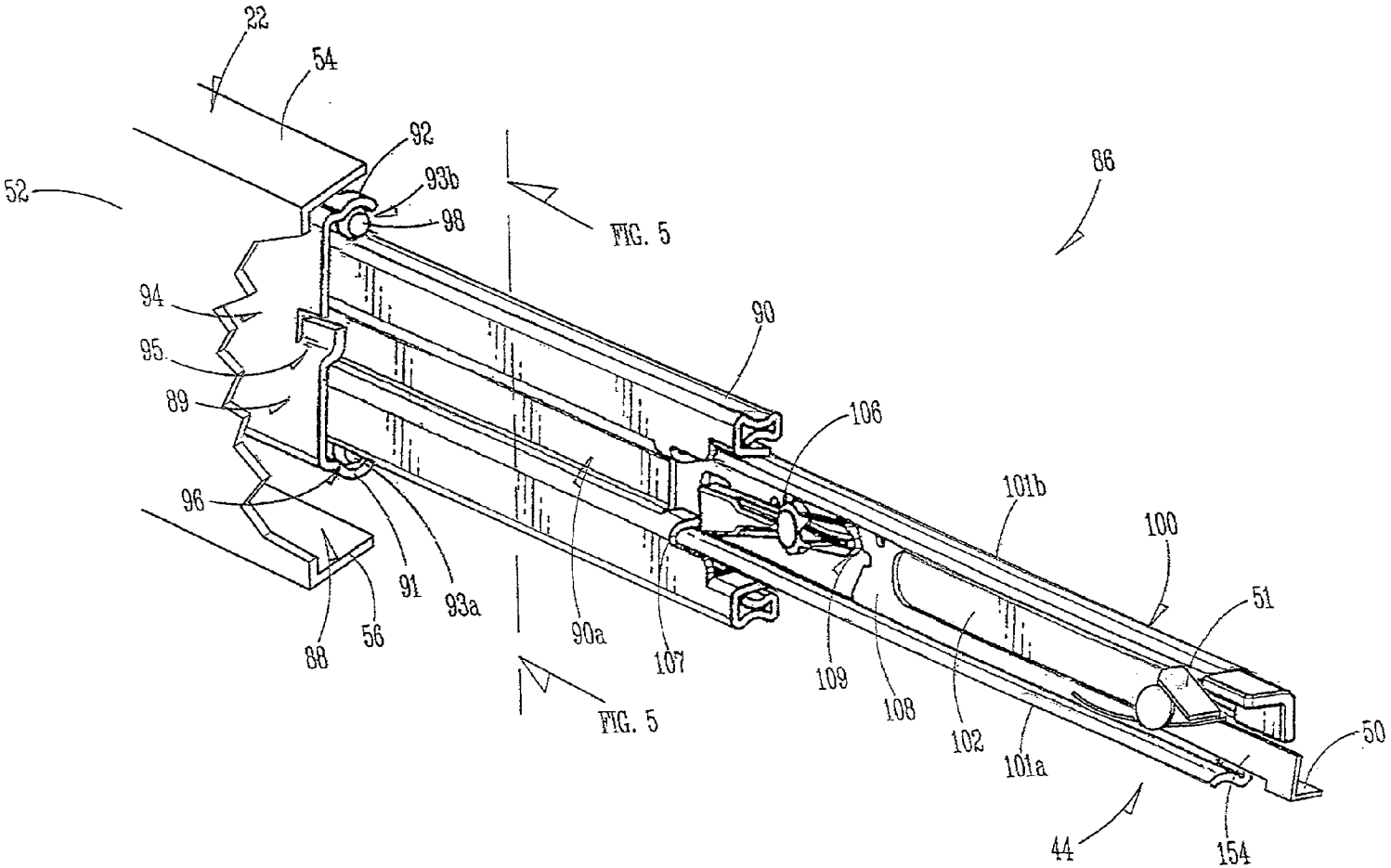
FIG. 4 is a perspective view of a slide assembly in an extended position, in accordance with embodiments of the invention.

Turning to FIG. 4, the illustrative first slide assembly 86 is depicted in a perspective drawing, showing the illustrative first slide assembly 86 in an extended position. It should be appreciated by those having skill in the relevant art that the second slide assembly 112 can, according to embodiments of the invention, be configured in substantially the same manner as the first slide assembly 86, described below, but with an opposite orientation. As shown, the first slide assembly 86 includes an outer slide portion 89 that slideably receives an intermediate slide portion 90, which, in turn, slideably receives a slide mount 100.

The outer slide portion 89 includes a lower portion 91 and an upper portion 92. A vertical web 94 extends between the lower and upper portions 91 and 92 of the outer slide portion 89. The lower portion 91 and the upper portion 92 extend inwardly toward the drawer body 12 and are curved to provide a lower portion of a lower raceway 93*a* and an upper portion of an upper raceway 93*b*. The upper portion of the lower raceway 93*a* and the lower portion of the upper raceway 93*b* are provided by the structure of the intermediate slide portion 90. A lower ball-bearing set 96 is disposed within the lower raceway 93*a* and an upper ball-bearing set 98 is disposed within the upper raceway 93*b*, thereby allowing the intermediate slide portion 90 to slide within the outer slide portion 89.

Figure 5:
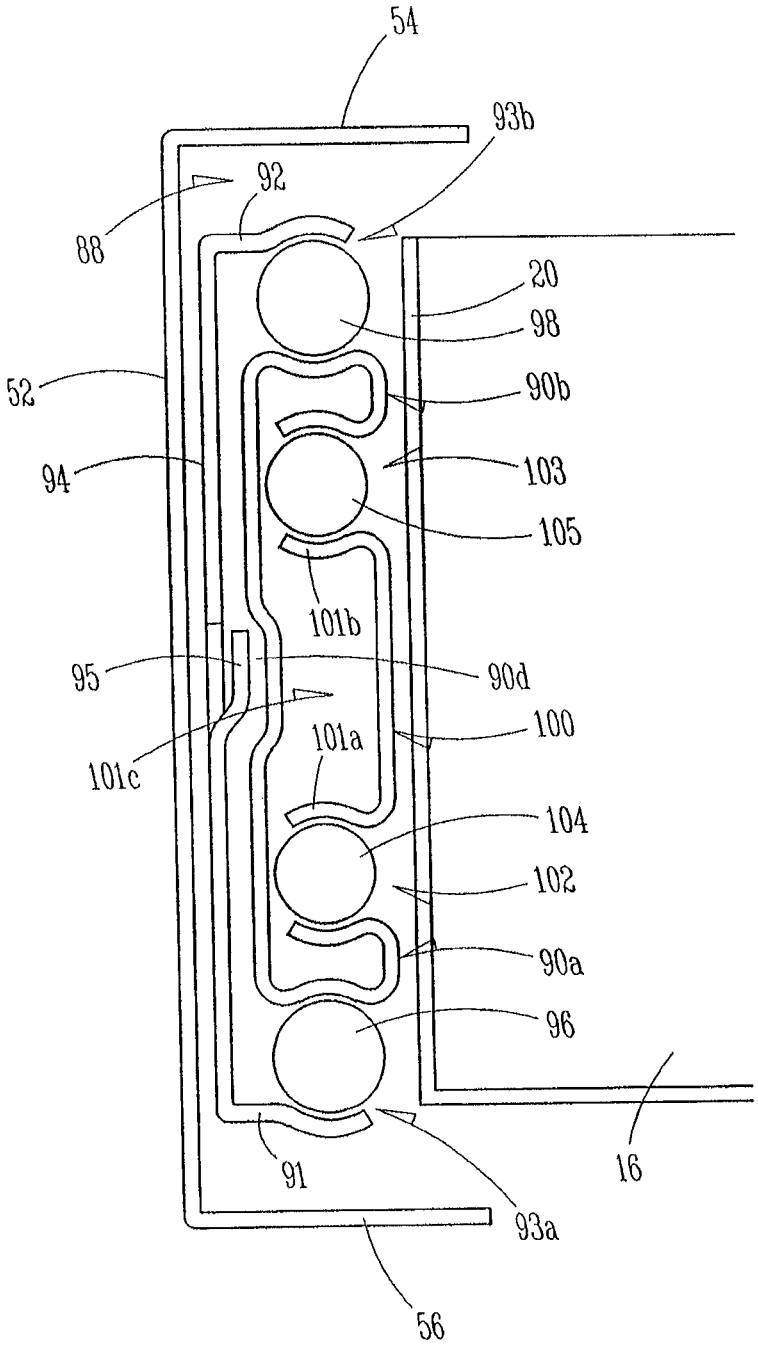
FIG. 5 is a cross-sectional view of the slide assembly of FIG. 4, in accordance with embodiments of the invention.
Figure 7:
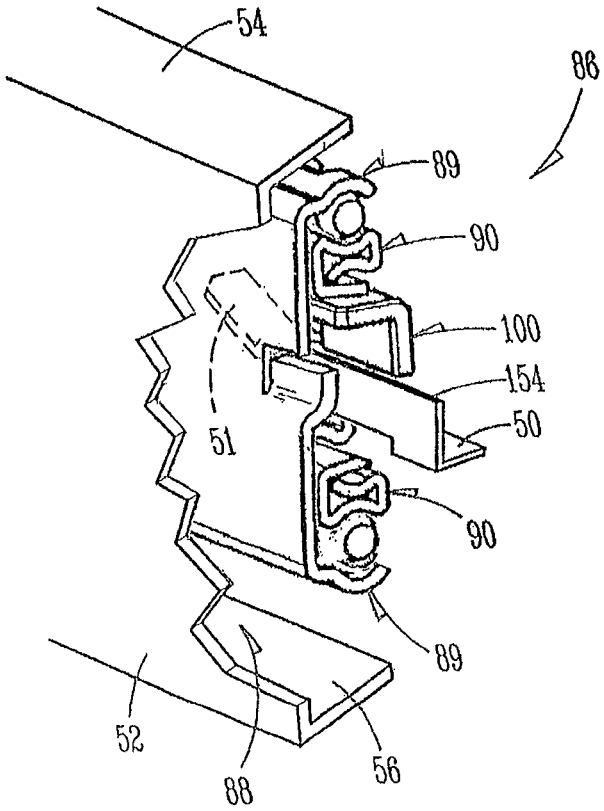
FIG. 7 is a perspective, cut-away view of the slide assembly of FIG. 4 in a collapsed position, in accordance with embodiments of the invention.

As is illustrated in FIGS. 4 and 5, the outer slide portion 89 also includes a blocking tab 95. The blocking tab 95 extends toward the drawer body 12 and can be engaged by engaging tab 51. As shown, the blocking tab 95 curves toward the drawer body 12 and then has a portion that extends substantially parallel to the vertical web 94. In other embodiments, the tab 95 could include any number of other configurations, all of which are considered to be within the ambit of the invention. With reference to FIG. 7, when the drawer is closed, the slide assembly 86 is collapsed. That is, the intermediate slide portion 90 is slideably disposed within the outer slide portion 89 and the slide mount 100 is slideably disposed within the intermediate slide portion 90. As illustrated, the slide mount 100 has been pushed far enough in that the engaging tab 51 is able to engage the blocking tab 95. While the engaging tab 51 is engaged with the blocking tab 95, the slide mount 100 cannot be pulled forward. Turning the handle 28 illustrated, for example, in FIG. 3, causes the engaging tab 51 to be lifted up above the level of the blocking tab so that the slide mount 100 can slide past the blocking tab.

As shown in FIGS. 4 and 5, the intermediate slide portion 90 includes a lower portion 90*a* and an upper portion 90*b*, joined by a vertical web 90*c* that extends between the lower portion 90*a* and the upper portion 90*b*. As shown in FIGS. 4 and 5, the vertical web 90*c* includes a channel 90*d*, in which the blocking tab 51 can be disposed as the intermediate slide portion 90 is pulled past the outer slide portion 89 (in either direction). As shown in FIG. 4, the lower portion 90*a* of the intermediate slide portion 89 provides the upper portion of the lower raceway 93*a* and the upper portion 90*b* of the intermediate slide portion 89 provides the lower portion of the upper raceway 93*b*. As illustrated, the lower portion 90*a* and upper portion 90*b* are curved to accommodate the lower ball-bearing set 96 and upper ball-bearing set 98, respectively.

As shown in FIGS. 4 and 5, the slide mount 100 includes a lower flange 101*a*, an upper flange 101*b*, and a vertical slide mount web 102 extending between the lower and upper flanges 101*a* and 101*b*, thereby defining a cavity 101*c*. In embodiments, for example, slide-blocking hardware can be disposed within the cavity 101*c*. Additionally, slide mount web 102 can be mounted to the side panel 20 of the drawer body 12. The lower and upper flanges 101*a* and 101*b* extend outwardly (e.g., away from the drawer body 12) and are curved to provide an upper portion of an additional lower raceway 102 and a lower portion of an additional upper raceway 103, respectively. As illustrated, the upper portion of the additional lower raceway 102 is provided by the lower portion 90*a* of the intermediate slide portion 90 and the lower portion of the additional upper raceway 103 is provided by the upper portion 90*b* of the intermediate slide portion 90. A ball-bearing set 104 is disposed within the additional lower raceway 102 and a ball-bearing set 105 is disposed within the additional upper raceway 103, thereby allowing the slide mount 100 to slide within the intermediate slide portion 90.

Figure 6A:
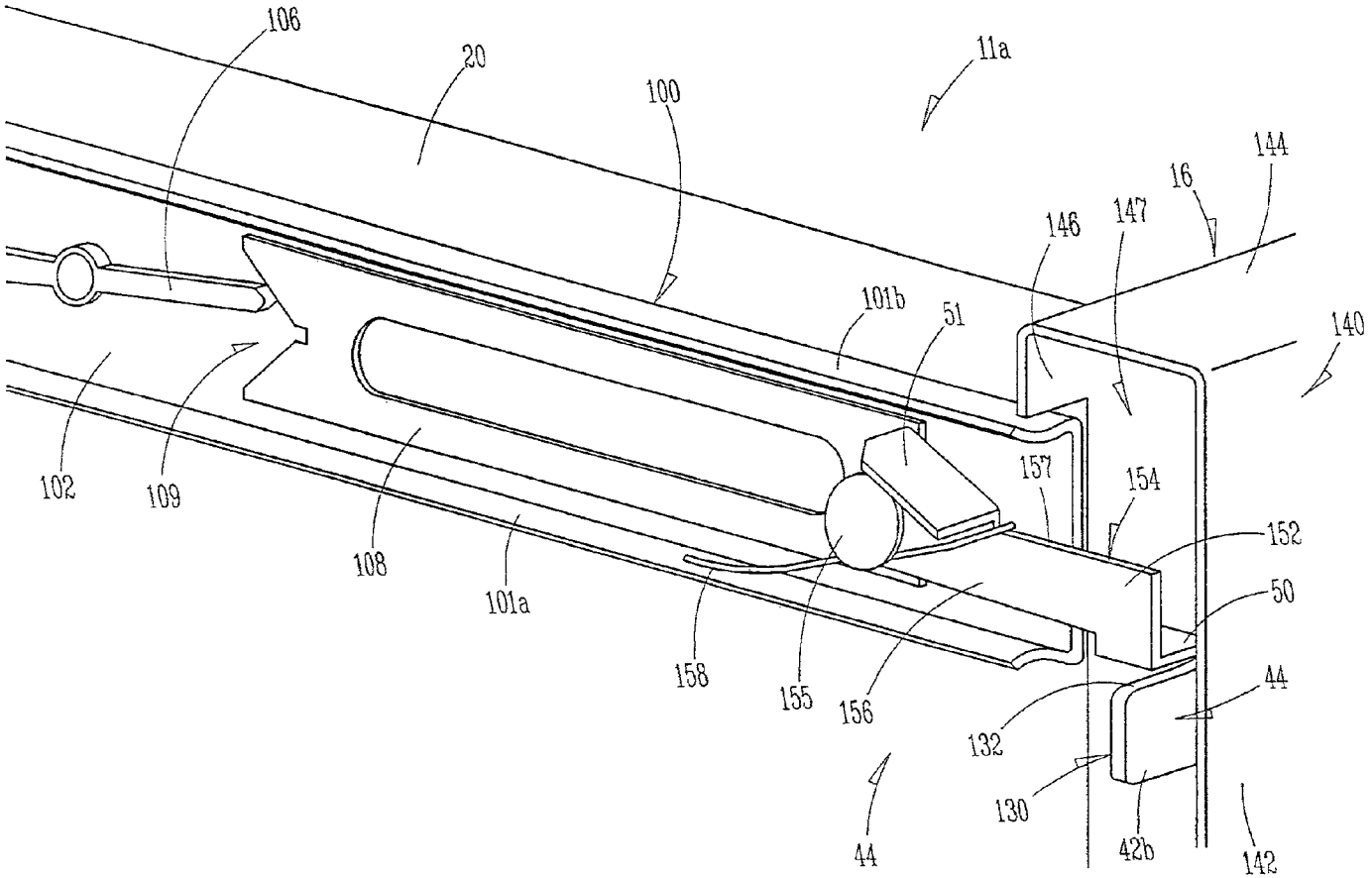
FIG. 6A is a perspective view of a portion of a drawer assembly, showing a blocking mechanism in a first position, in accordance with embodiments of the invention.
Figure 6B:
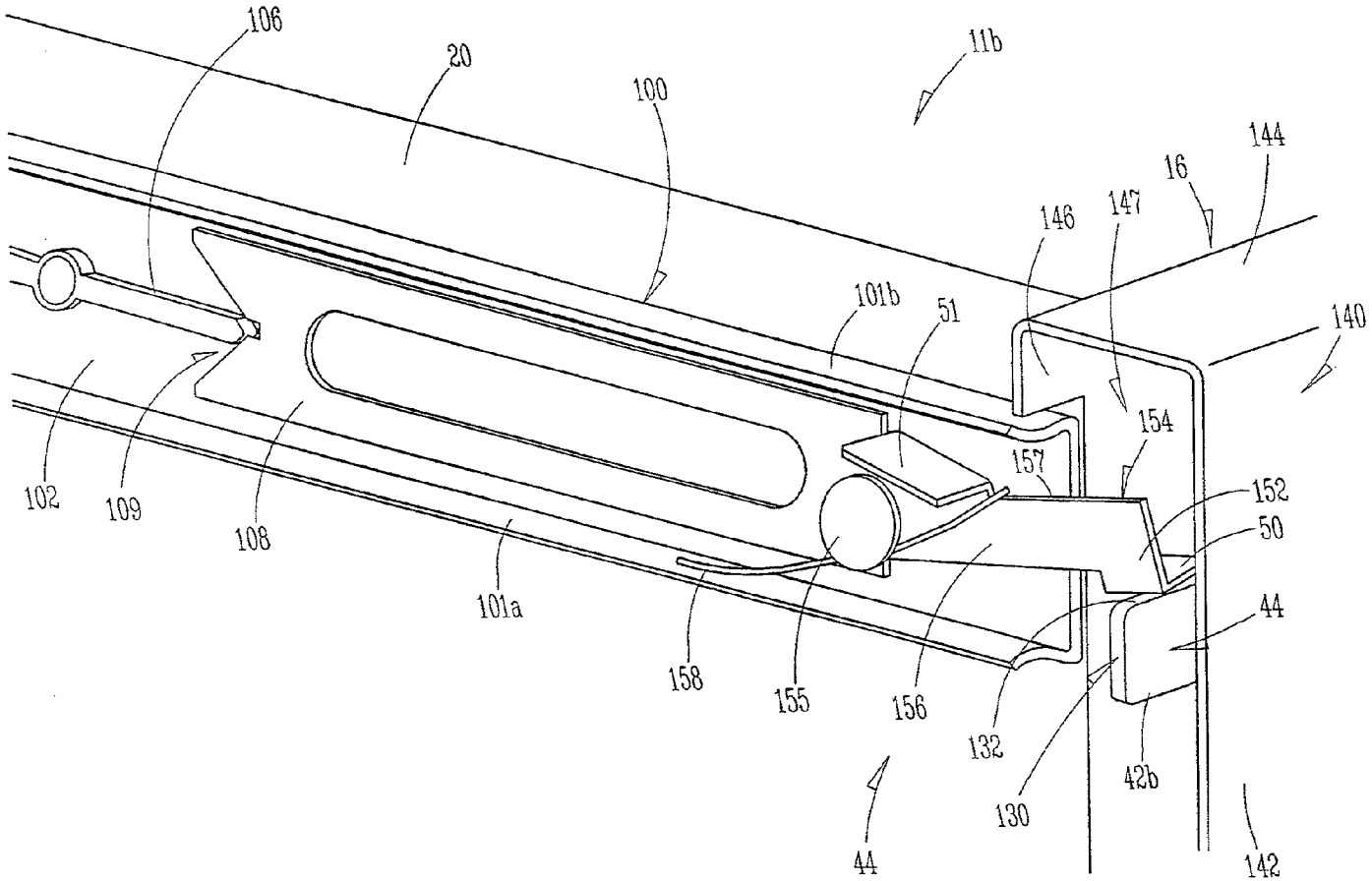
FIG. 6B is a perspective view of the portion of the drawer assembly of FIG. 6A, showing the blocking mechanism in a second position, in accordance with embodiments of the invention.

As shown in FIGS. 4, 6A, and 6B, the slide mount 100 can also, optionally, include a slide-catch 106 that engages an engagement portion 107 of the intermediate slide portion 90. In this manner, the slide assembly 86 can be locked in an extended position. As illustrated, the slide mount 100 can include a base plate 108 to which, for example, the blocking mechanism 44 is pivotably coupled, at one end. At the other end, the base plate 108 can include a notch 109 that can receive a portion of the slide-catch 106 to allow the slide-catch 106 to pivot out of engagement with the engagement portion 107 of the intermediate slide portion 90, thereby allowing the slide mount 100 to slide into the intermediate slide portion 90.

Turning now to FIGS. 6A and 6B, perspective views of the slide mount 100 and blocking mechanism 44 are illustrated in the first 11*a* and second 11*b* positions, respectively. It should be understood by individuals having skill in the relevant arts that the drawer assembly 10 can include similar features to those illustrated in FIGS. 4A and 4B on the opposite side of the drawer body 12. Additionally, the slide mount 100 and/or blocking mechanism 44 can include any number of additional features as well as those described herein. As shown in FIGS. 6A and 613, the slide mount 100 is fixed to the side panel 20 of the drawer body. The base plate 108 is fixed to the vertical web 102 and includes, at the forward end, the blocking mechanism 44 and, at the rear end, a notch 109 that receives the slide-catch 106.

As illustrated, the blocking mechanism 44 includes an actuator member 154, the actuator tab 50 that can be engaged by an upper surface 132 of an outside end 130 of the second portion 42*b* of the lever 42, an engagement tab 51, and an elastic mechanism 158. As shown in FIGS. 6A and 6B, the actuator tab 50 extends inwardly (e.g., toward the drawer body 12, as shown in FIG. 1) away from a first portion 152 of the actuator member 154. The actuator tab 50 extends inwardly so that it can extend behind a front guard 140. The actuator tab 50 and lever 42 (as well as, for example, additional components such as the arm member 40, components of the twist-lock mechanism 26, and the like) are covered by the front guard 140. In this manner, the actuator tab 50 and the lever 42 that actuates the actuator tab 50 are protected from tampering and other forms of damage or compromise by the front guard 140. The front guard 140 includes a front wall 142 that is oriented substantially parallel to the front panel 16 on the drawer body 12. The front guard 140 further includes an upper wall 144 and a rear wall 146 that create a cavity 147. It should be understood, though not illustrated herein, that the front guard 140 can further include a lower wall. Thus, the locking components and tab 50 can be disposed within the cavity 147.

With continued reference to FIGS. 6A and 6B, the first portion 152 of the actuator member 154 extends substantially vertically away from the outside end of the tab 50, to which it is fixed. A second portion 156 of the actuator member 154 extends away from the upper end of the first portion 152 in a substantially perpendicular direction (i.e., toward the rear of the drawer assembly), thereby creating a roughly L-shaped main body. The actuator member 154 is pivotably coupled, at the rear end thereof, to the slide mount 100 via a pivot 155. In some embodiments, the actuator member 154 can be pivotably coupled directly to the slide mount 100, while in other embodiments, the actuator member 154 can be pivotably coupled to another structure such as, for example, the base plate 108. The engagement tab 51 extends outwardly away from an upper surface 157 of the actuator member 154.

As illustrated in FIG. 6A, in the first position 11*a*, the engagement tab 51 is oriented at an angle with respect to the horizontal such that the engagement tab 51 slopes upward toward the rear of the drawer assembly 10. Because of this orientation of the engagement tab 51, in some embodiments, the drawer assembly 10 can be closed without turning the handle. When the drawer body 12 is slid into the cabinet enclosure 14, the angle of the engagement tab 51 allows it to be forced up and over the front of the blocking tab 95, thereby allowing for the drawer body 14 to be disposed within the cabinet assembly 14. The actuating member is biased toward the first position 11*a*, illustrated in FIG. 6A, using an elastic mechanism 158 such as, for example, a spring or other tensioning device. When the drawer assembly 10 is closed, and the slide assembly 86 is, therefore, collapsed (as shown in FIG. 7), the engagement tab 51 engages the blocking tab 95, preventing the slide mount 100 from being slid out of its position 11*a* within the intermediate slid portion 90.

In operation, as illustrated in FIG. 6B, the upward motion of the outside end 130 of the lever 42 causes the upper surface 132 thereof to engage the tab 50. The force of the lever 42 on the actuator tab 50 overcomes the biasing tension provided by the elastic mechanism 158, allowing the actuator member 154 to pivot about the pivot 155 into the second position 11*b*, illustrated in FIG. 6B, causing the engagement tab 51 to move upwardly. In this manner, as described above, the engagement tab 51 can be disengaged from the blocking tab 95 on the outer slide portion 89, allowing the drawer to be opened. Similarly, the handle can be released (or the upward force of the lever 42 otherwise discontinued) to allow the elastic mechanism 158 to cause the actuating member 154 to return to the first position 11*a*, illustrated in FIG. 6A.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

The invention claimed is:

1. A slide assembly that facilitates slideably mounting a drawer body within a cabinet enclosure, the slide assembly comprising:

a slide mount that is fixed to a side panel of the drawer body;

an outer slide portion that is fixed to a side member of the cabinet enclosure and has a blocking tab disposed thereon, wherein the slide mount can be slideably disposed within the outer slide portion;

an actuator member pivotably coupled to the slide mount;

an actuator tab, coupled with the actuator member, that extends inwardly away from the actuator member;

a lever that actuates the actuator tab; and an engagement tab coupled to the actuator member and extending outwardly away from the actuator member, wherein the engagement tab is adapted to engage said blocking tab disposed on the outer slide portion, wherein the slide mount includes a vertical slide mount web between the side panel and the actuator member and the actuator member is arranged outward of the vertical slide mount web, wherein the slide mount extends in a first direction and the lever rotates about an axis that is parallel to the first direction.

2. The slide assembly of claim 1, further comprising an intermediate slide portion that can be slideably disposed within the outer slide portion.

3. The slide assembly of claim 2, wherein the slide mount is slideably disposed within the intermediate slide portion.

4. The slide assembly of claim 3, wherein the intermediate slide portion includes a channel within which the blocking tab is disposed.

5. The slide assembly of claim 1, wherein the actuator member is biased toward a first position using an elastic mechanism.

6. The slide assembly of claim 5, wherein the elastic mechanism includes a spring.

7. The slide assembly of claim 1, wherein the lever is configured to lift the engagement tab above the blocking tab via the actuator member and actuator tab.

8. The slide assembly of claim 1, wherein the actuator pivots about an axis orthogonal to a plane formed by the vertical side mount web.

9. The slide assembly of claim 1, wherein the actuator tab extends inward of an inner side of the vertical slide mount web.

10. The slide assembly of claim 1, wherein when the lever is configured to rotate about a first axes and the actuator member is configured to rotate about a second axis perpendicular to the first axis.

11. A drawer assembly that includes a drawer body slideably disposed within a cabinet enclosure, the drawer assembly comprising:

a drawer body having a front panel, rear panel, and two opposed side panels; and a slide assembly that is slideably coupled between a side panel and the cabinet enclosure, wherein the slide assembly includes an outer slide portion having a blocking tab disposed thereon and, wherein the slide assembly further includes a slide mount having an actuator member pivotably coupled thereto, the actuator member including an engagement tab extending outwardly and an actuator tab extending inwardly;

a lever that actuates the actuator member by engaging the actuator tab; and a front guard that is disposed over the actuator tab and the lever, wherein the slide mount includes a vertical slide mount web between the side panel and the actuator member and the actuator member is arranged outward of the vertical slide mount web, wherein the slide mount extends in a first direction and the lever rotates about an axis that is parallel to the first direction.

* * * * *